US005280908A

United States Patent [19]

Lu

[11] Patent Number: 5,280,908

[45] Date of Patent: Jan. 25, 1994

[54] PEN CASE WITH A PINBALL GAME SET

[76] Inventor: Ing-Chiueh Lu, No. 14, Lane 430, Section 2, Dah Torng Road, Tainan, Taiwan

[21] Appl. No.: 95,189

[22] Filed: Jul. 23, 1993

[51] Int. Cl.[5] ..... A63F 7/02

[52] U.S. Cl. ..... 273/121 R; D3/30.1; 206/371; 206/2.6; 206/38

[58] Field of Search ..... 273/118-125; 206/214, 216, 579, 37, 38, 315.1, 371; D3/30.1

[56] References Cited

U.S. PATENT DOCUMENTS

D. 157,534 2/1950 Price ..... D3/30.1 X
3,623,728 11/1971 Goldfarb ..... 206/315.1 X
5,020,662 6/1991 Aida ..... 206/371 X
5,134,918 8/1992 Chang ..... 206/371 X

*Primary Examiner*—Vincent Millin
*Assistant Examiner*—Raleigh W. Chiu

[57] ABSTRACT

A pen case with a pinball game set comprises a case body for storing pens and an upper lid connected with the case body by way of a pivotal shaft which swings open or closed on the case body. The pinball game set is fixed on the upper lid and allows for the punching of steel balls up and down irregularly located pins and through channels to obtain scores. A movable fence stops balls in the channels and permits balls to fall down to a waiting room defined by an inclined horizontal plate and the movable fence; steel balls in the waiting room roll down a passageway on the puncher to be punched by pulling the movable fence leftward.

1 Claim, 4 Drawing Sheets

PEN CASE WITH A PINBALL GAME SET

BACKGROUND OF THE INVENTION

A conventional pen case shown in FIG. 1 generally has a case body 10 and a lid 11 to cover on the case body 10 for placing pens, pencils, erasers, etc, having no special functions.

SUMMARY OF THE INVENTION

This invention has been devised to offer a pen case with a pinball game set for practical use and a recreational play as well.

A pen case with a pin ball game set in the present invention comprises a case body for placing pens, erasers, etc. and an upper lid pivotally connected with the case body to swing open and closed on the case body, and a pinball game set combined with the upper lid so as to play pin ball game and to store pens therein, having advantages of (1) simple components and easy assemblage and (2) double functions of storing pens and of a recreation.

DETAILED DESCRIPTION OF THE INVENTION

Figure 1:
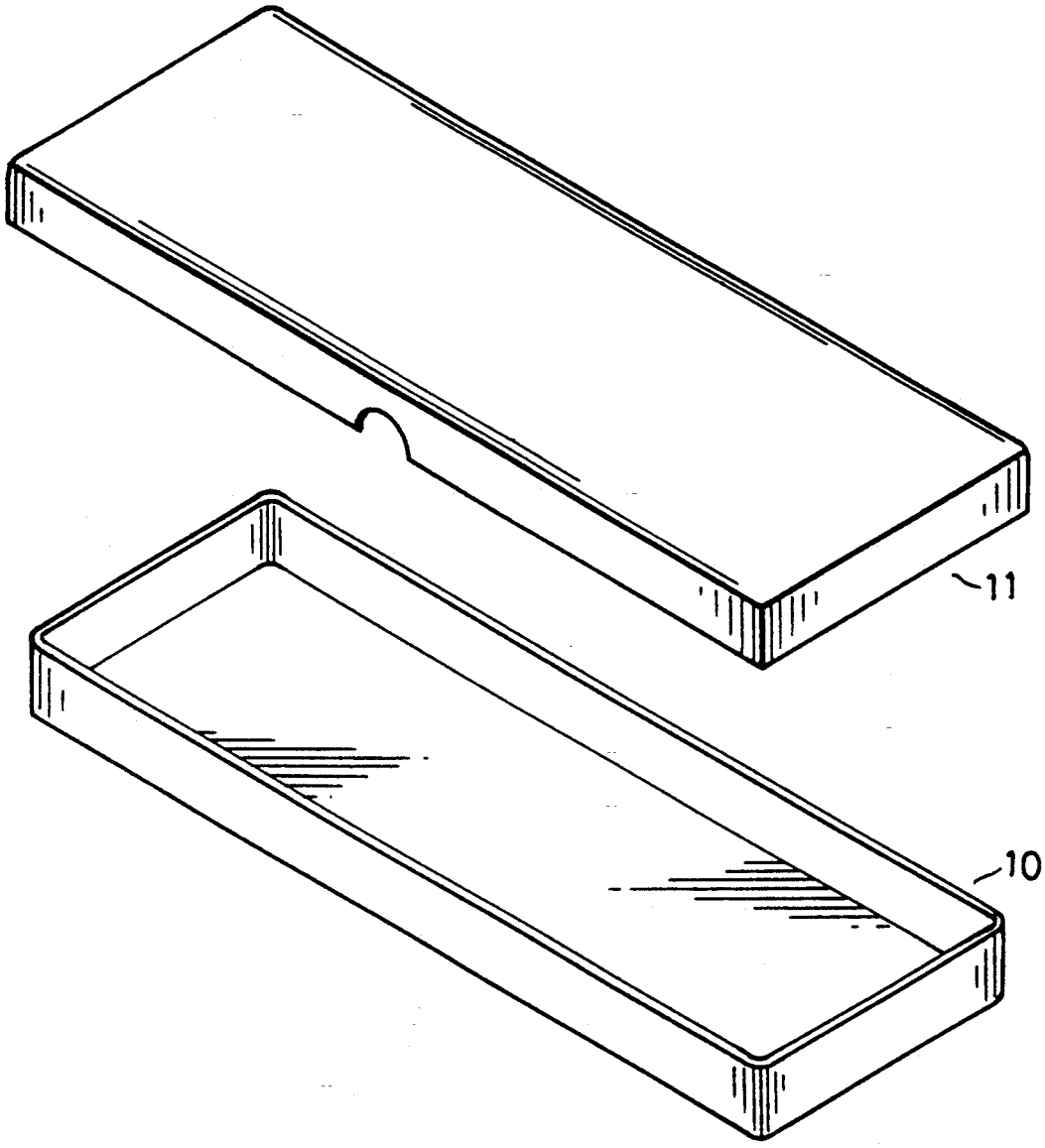
FIG. 1 is an exploded perspective view of a conventional pen case.
Figure 2:
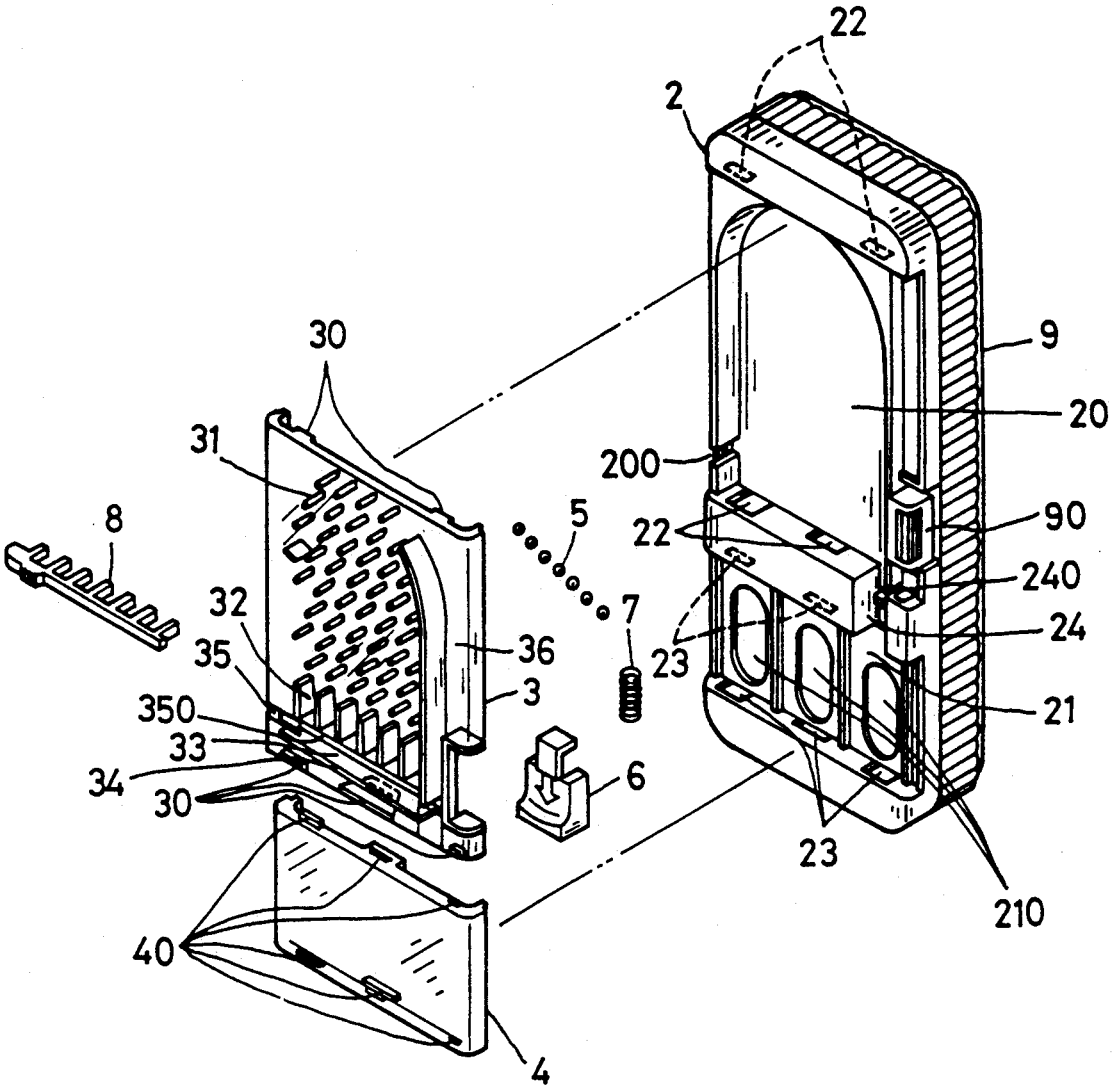
FIG. 2 is an exploded perspective view of a pen case with a pinball game set in the present invention.
Figure 3:
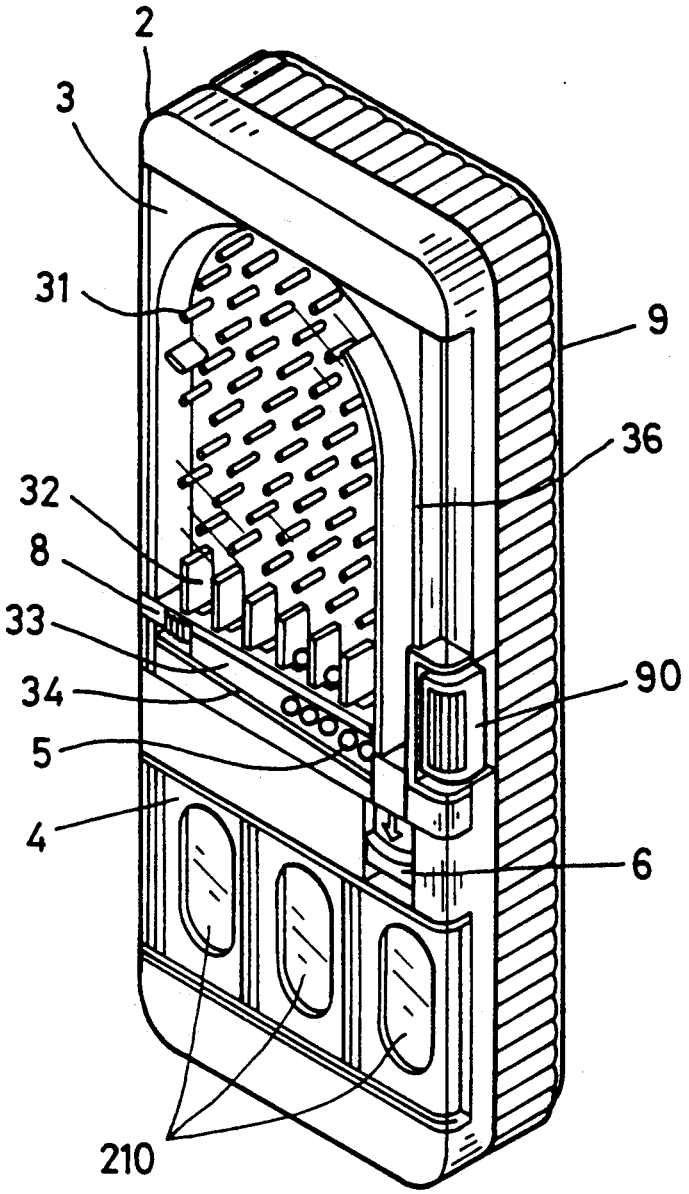
FIG. 3 is a perspective view of the pen case with a pinball game set in the present invention.

A pen case with a pinball game set in the present invention, as shown in FIGS. 2 and 3, comprises a case body 9, an upper lid 2, a pinball board 3, a transparent board 4, a plurality of steel balls 5, a ball puncher 6, a spring 7 and a movable fence 8 as its main components.

The case body 9 is shaped rectangular, having a bottom, a circumferential wall and an open upper side, and pivotally conconnected with the upper lid 2, which is kept closed by a push button 90. The empty space defined by the bottom and the circumferential is for placing pens, erasers, etc.

The upper lid 2 is shaped rectangular the same as the case body 9 and provided to swing open or closed on the case body 9 by means of a pivotal long shaft (not shown in the drawings), having an upper recessed cavity 20 and a lower recessed cavity 21 divided by an intermediate wall 25, two engage holes 22 spaced in an upper horizontal side of the rectangular intermediate wall 25, three engage holes 23 in an upper side of a lower rectangular wall 26, a passageway 24 in the right side communicating the upper cavity 20 with the lower cavity 21, a stopper 240 in an upper portion of the passageway 24, a notch 200 in a left side wall of the upper cavity 20, and three oval windows 210 properly spaced apart in the bottom of the lower cavity 21.

The pinball board 3 is transparent, provided to cover on the upper cavity 20 of the upper lid 2, having a plurality of pins 31 irregularly fixed on an inner surface to project down to the flat bottom wall of the upper cavity 20, which functions as the bottom plate of the pinball game set, a plurality of channels 32 equally divided by rectangular small plates 37, an inclined long plate 34 horizontally fixed on the inner surface below the channels 32 to lead steel balls to slide down to the passageway 24 in the upper lid 2, a ball waiting room 33 formed between the inclined long plate 34 and a movable fence 8 under the channels 32, a notch 35 in a left side edge and a long horizontal slot 350 communicating the notch 35 for the movable fence 8 to fit and move horizontally therein, and a rolling way 36 formed between the right side wall of the cavity 20 and a separating wall 38 fixed vertically on the inner surface for the balls 5 to roll along when punched by the puncher 6.

The transparent board 4 is shaped rectangular, covering the lower cavity 21, and provided with three windows 210, for looking through the windows 210 to check what are contained in this case, having projections 40 spaced apart on the upper edge and the lower edge to engage with the engage holes 22 and 23 of the upper lid 2 so as to combine the board 4 with the upper lid 2.

The plurality of small steel balls 5 are provided to be stored in the ball waiting room 33 on the inclined plate 34, and to roll down along the inclined plate 34 to enter the passageway 24 so as to be punched by the puncher 6.

The ball puncher 6 is provided in the passageway 24, able to be moved down manually and pushed up by means of the spring 7 compressed by the puncher 6 for punching the steel balls up to roll down through the pins 31 and then into one of the channels 32 indicated with scores.

The movable fence 8 is provided horizontally under the channels 32, fitting in the notch 35 and the long horizontal slot 350 of the pinball board 3 and having a plurality of parallel feet 81 extending down to the bottom surface of the cavity 20 so that the feet 81 can stop the steel balls 5 with help of the separating plates 37 of the pinball board 3 when the movable fence 8 is in a first position, and permit the balls 5 to pass through to drop down in the ball waiting room for next play when the movable fence 8 is in a second position. The first position of the movable fence 8 is that the fence 8 is pulled to the right to close the channels, with the feet 81 of the fence 8 preventing the balls 5 from rolling down to the ball waiting room 33, and the second position of the fence 8 is that the fence 8 is pulled to the left opening the channels 32, with the feet 81 aligned to the separating plates 37 permitting the balls 5 to drop down in the room 33.

Figure 4:
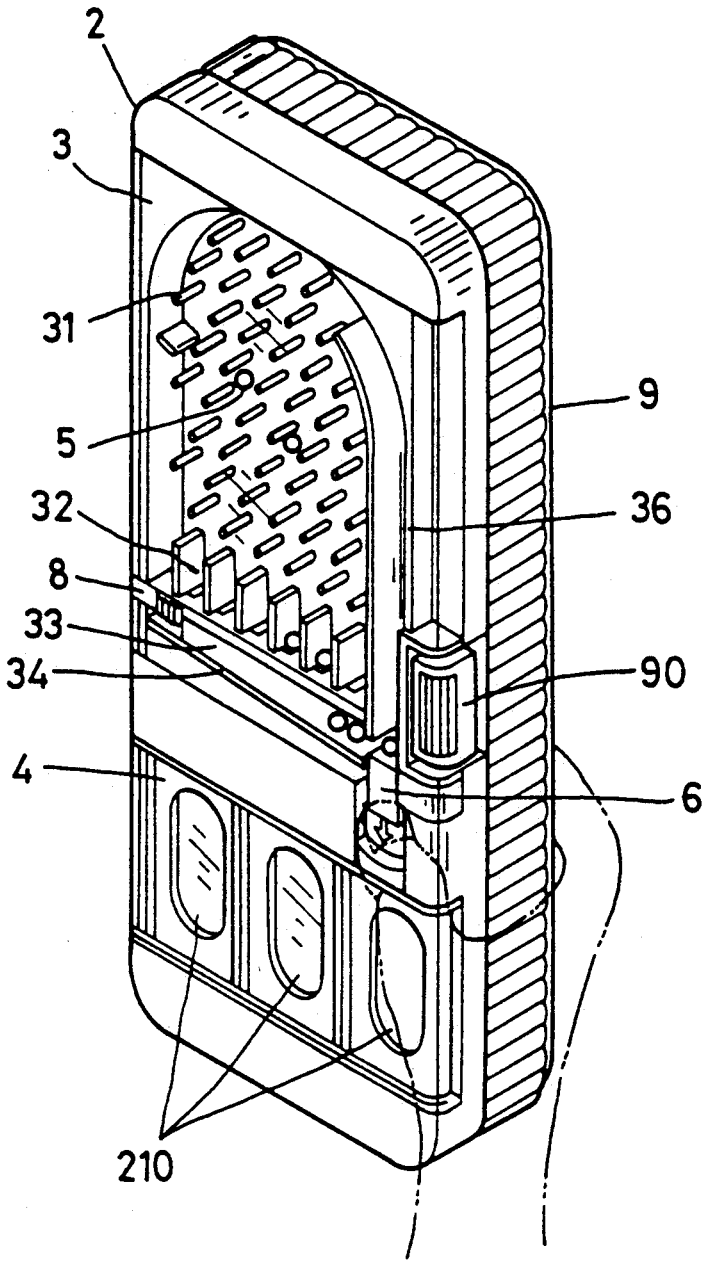
FIG. 4 is a perspective view of the pen case with a pinball game set in the present invention, showing how to use the pin ball game set.

In playing the pinball game set in the present invention, the puncher 6 is pushed down, as shown in FIG. 4, to let a ball 6 in the waiting room 33 to roll down in the passageway 24 and on the puncher 6, and then released to punch a ball 6 up the rolling way 36, then the ball slowly drops down through and bump with the pins 31 and finally falls in one of the channels 32 indicating scores stopped by the movable fence 8. Thus punching is repeated to the last ball 5, and then the movable fence 8 is to be pulled to the left to the second position, permitting all the balls 5 to drop down in the waiting room 33 for next round of play.

What is claimed is:

1. A pen case with a pinball game set comprising;

a rectangular case body, having a bottom wall and a circumferential wall and a hollow cavity defined by the bottom wall and the circumferential wall for placing pens;

an upper lid shaped the same as said case body and connected with said case body by means of a long pivotal shaft to swing open and closed on said case body, and having;

(1) an upper recesssed cavity;

(2) a lower recessed cavity;

(3) an intermediate horizontal wall dividing said upper recessed cavity from the lower recessed cavity, having two engaging holes respectively in its upper side and its lower side for four projections of a transparent pinball board to fit therein;

(4) a lower horizontal wall having several engaging holes in its upper side for projections of a transparent rectangular board to fit therein and three oval windows spaced apart;

(5) a passageway in the right side communicating the upper recessed cavity and the lower recessed cavity for a puncher to fit and move therein and also for a steel ball to enter therein;

(6) a notch in the left side edge for a movable fence to fit and move therein;

a transparent pinball board fitted on said upper recessed cavity, having;

(1) a plurality of pins fixed irregularly on an inner surface extending down to the bottom wall of said upper recessed cavity of said upper lid for steel balls to pass through to fall down into channels;

(2) a vertical rolling way formed between the right side wall of the said upper cavity of said upper lid and a vertical long plate fixed vertically, and communicating with said passageway of the upper lid for balls to roll up through to fall among said pins when the balls are punched by a puncher;

(3) a plurality of channels below the pin area divided by a plurality of vertical rectangular separating plates equally spaced apart and fixed on the inner surface extending down to the bottom wall of said upper recessed cavity of said upper lid;

(4) an inclined long horizontal plate fixed on the inner surface for steel balls to rest on and roll along to move in the passageway when the puncher is pulled down;

(5) a ball waiting room defined by said inclined horizontal plate and a plurality of feet of a movable fence for the steel balls to stay therein when the balls fall down from said channels when the movable fence is pulled to the left;

(6) a long horizontal slot under said channels and a notch in the left edge communicating with said long horizontal slot for the movable fence to fit and move therein:

(7) two projections respectively on an upper side and a lower side to fit said engage holes of said upper lid to combine the pinball board with said upper lid;

a transparent rectangular plate covering on said lower recessed cavity of said upper lid, having two projections on its upper side and three projections on its lower side to engage said engage holes of said upper lid to combine the transparent rectangular plate with said upper lid so as to look through said three windows of said upper lid to check things placed in said case body;

a rectangular ball puncher to fit in said passageway of said upper lid and elastically urged by a spring to move back quickly to its normal upper position when it is pushed manually down to a down position so as to punch a steel ball; and a movable fence fitting and moving horizontally in said slot and said notch of said pinball board, having a plurality of parallel feet extending down to said bottom wall of said upper cavity of said upper lid to stop steel balls from rolling down in said waiting room, or to permit the steel balls roll down in said waiting room when the movable fence is pushed to the left, letting the feet align to said separating plates of said channels.

* * * * *